US009238180B2

(12) United States Patent
Kennedy

(10) Patent No.: US 9,238,180 B2
(45) Date of Patent: Jan. 19, 2016

(54) MODULAR CONSTRUCTION PANEL

(71) Applicant: Samuel Kennedy, Toronto (CA)

(72) Inventor: Samuel Kennedy, Toronto (CA)

(73) Assignee: FELTRO INC., Toronto (CA)

( * ) Notice: Subject to any disclaimer, the term of this patent is extended or adjusted under 35 U.S.C. 154(b) by 0 days.

(21) Appl. No.: 14/055,333

(22) Filed: Oct. 16, 2013

(65) Prior Publication Data

US 2015/0104993 A1 Apr. 16, 2015

(51) Int. Cl.
*E04B 1/00* (2006.01)
*A63H 33/10* (2006.01)

(52) U.S. Cl.
CPC ..... *A63H 33/10* (2013.01)

(58) Field of Classification Search
USPC ..... 52/5, 63, 122.1; 40/610
See application file for complete search history.

(56) References Cited

U.S. PATENT DOCUMENTS

| | | | | |
|---|---|---|---|---|
| 168,063 | A | 9/1875 | Taylor | |
| 3,637,217 | A | 1/1972 | Kent | |
| 3,687,455 | A | 8/1972 | Odier | |
| 4,182,063 | A * | 1/1980 | Klosel | 40/610 |
| 4,227,334 | A | 10/1980 | Hooker | |
| 4,343,471 | A | 8/1982 | Calvert | |
| 4,674,982 | A | 6/1987 | Mackey | |
| 4,676,507 | A | 6/1987 | Patterson | |
| 5,301,953 | A | 4/1994 | Levin | |
| 5,762,529 | A | 6/1998 | Nizza | |
| 5,819,448 | A | 10/1998 | Kieves et al. | |
| 6,718,670 | B2 * | 4/2004 | Wang | 40/610 |
| 7,104,864 | B1 | 9/2006 | Liou | |
| D569,064 | S | 5/2008 | Hinder et al. | |
| 2009/0133342 | A1 * | 5/2009 | Copeland | 52/202 |
| 2013/0112355 | A1 * | 5/2013 | Roth et al. | 160/127 |
| 2014/0256210 | A1 | 9/2014 | Johnson | |
| 2015/0104993 | A1 | 4/2015 | Kennedy | |

FOREIGN PATENT DOCUMENTS

| | | |
|---|---|---|
| CA | 2051905 | 6/1992 |
| CA | 2366583 | 12/2000 |
| CA | 2670298 | 5/2008 |
| CA | 2692560 | 1/2009 |

OTHER PUBLICATIONS

Magna-Tiles, online: http://www.magnatiles.com/.
MetroMags, online: https://www.facebook.com/MetroMags.
PowerClix, online: http://www.guidecraft.com/products/633637.
Magformers, online: http://www.mastermindtoys.com/Magformers.aspx.
Fractiles, online: http://www.fractiles.com/.
Magnetic Art, online: http://www.educationalinsights.com/product/magnetic+art.do.
Moonish, online: http://www.moonishco.com/.
Foam Fun!, online: http://www.amazon.com/Foam-Fun-Magnets-Pattern-Blocks/dp/B0015KGFQM.

(Continued)

*Primary Examiner* — Patrick Maestri
(74) *Attorney, Agent, or Firm* — Perry + Currier Inc.

(57) ABSTRACT

A modular construction panel is provided. The modular construction panel has a panel having a plurality of fasteners disposed within or thereon, each fastener permitting adjoining to a like construction panel for creating a structure. The panels are provided in shapes optimizing modularity when mated to other panels.

22 Claims, 10 Drawing Sheets

(56) References Cited

OTHER PUBLICATIONS

Soft Foam Magnets, online: http://www.learningresources.com/product/soft+foam+magnetic+rainbow+fraction--174-+tiles.do#.
Imaginarium, online: http://www.imaginarium.ie/magnetic-construction-pieces-50065.htm.
Squashblox, online: http://daydreamtoy.com/our-toys/squashblox/.
Kvadratclouds.com, "Clouds, Unique Design, Uniquely You—Designed by Ronan and Erwan Bouroullec, Presented by Kvadrat". (2009) Retrieved from http://web.archive.org/web/20090119080742/http://www.kvadratclouds.com/, on Jul. 22, 2015.
Mosaic Geometric self-adhesive foam shapes, Oriental Trading Company, reviewed Aug. 5, 2010, [online], [retrieved on May 16, 2015] Retrieved from Google search <http://www.orientaltrading.com/mosaic-geometric-self-adhesive-foam-shapes-a2-572252__fltr?Ntt=foam%20mosaic>.

* cited by examiner

MODULAR CONSTRUCTION PANEL

FIELD OF THE INVENTION

The following relates generally to construction panels and more particularly to a modular construction panel.

BACKGROUND

It is well understood that construction sets (e.g., construction-based toys) are highly beneficial to the mental development of children. Construction toys generally are marketed in specific kits, each of which enables a child to construct a particular structure. In other words, often the kit contains various components selected for the specific purpose of building the particular structure. Unless the kit contains many different components, it can be difficult to construct alternative structures, mitigating the potential for the child to demonstrate creativity.

A more modular approach to construction toys, where kits can be used for an indeterminate number of structures, would allow the child to better utilize creative skills.

SUMMARY

In one aspect, a modular construction panel is provided, said modular construction panel comprising a flexible panel having a plurality of fasteners disposed within or thereon, each said fastener permitting adjoining to a like modular construction panel for creating a structure.

The modular construction panel may comprise fasteners disposed at corners of said panel. Said fasteners may be disposed to achieve a lap joint of said like adjacent modular construction panel. Said fasteners may be disposed such that each said fastener is equidistant from its nearest neighbouring fasteners.

The modular construction panel may be substantially trapezoidal. The trapezoidal modular construction panel may have a longer base substantially twice the length of a shorter base and two legs extending from said longer base at approximately sixty degrees. The modular construction panel may comprise five fasteners, wherein said five fasteners are disposed substantially at the four corners of said trapezoid and midway between said fasteners disposed at the corners of the base of said trapezoid. The modular construction panel may comprise stitching, ultrasonic welding or glue to maintain said fasteners in position.

The fasteners may be magnets disposed within said modular construction panel.

The modular construction may comprise a plurality of layers comprising two surface layers. The modular construction panel may further comprise an internal layer. The surface layers may comprise a non-woven material, which may be felted. The internal layer may comprise a flexible material. The flexible material may have a rigidity sufficient to permit a structure built with a plurality of said modular construction panels to be self-supporting.

BRIEF DESCRIPTION OF THE DRAWINGS

The features of the invention will become more apparent in the following detailed description in which reference is made to the appended drawings wherein.

DETAILED DESCRIPTION

The following provides a modular construction panel. Each panel is flexible and has a plurality of fasteners disposed within it or on its surface. The panels are provided in shapes optimizing modularity when mated to other panels. In particular embodiments, only one size and shape of panel is required for constructing several structures comprising two or three dimensional shapes and surfaces. However, panels of various shapes are contemplated and, in specific examples, panels of substantially symmetrical shapes are contemplated.

Figure 1:
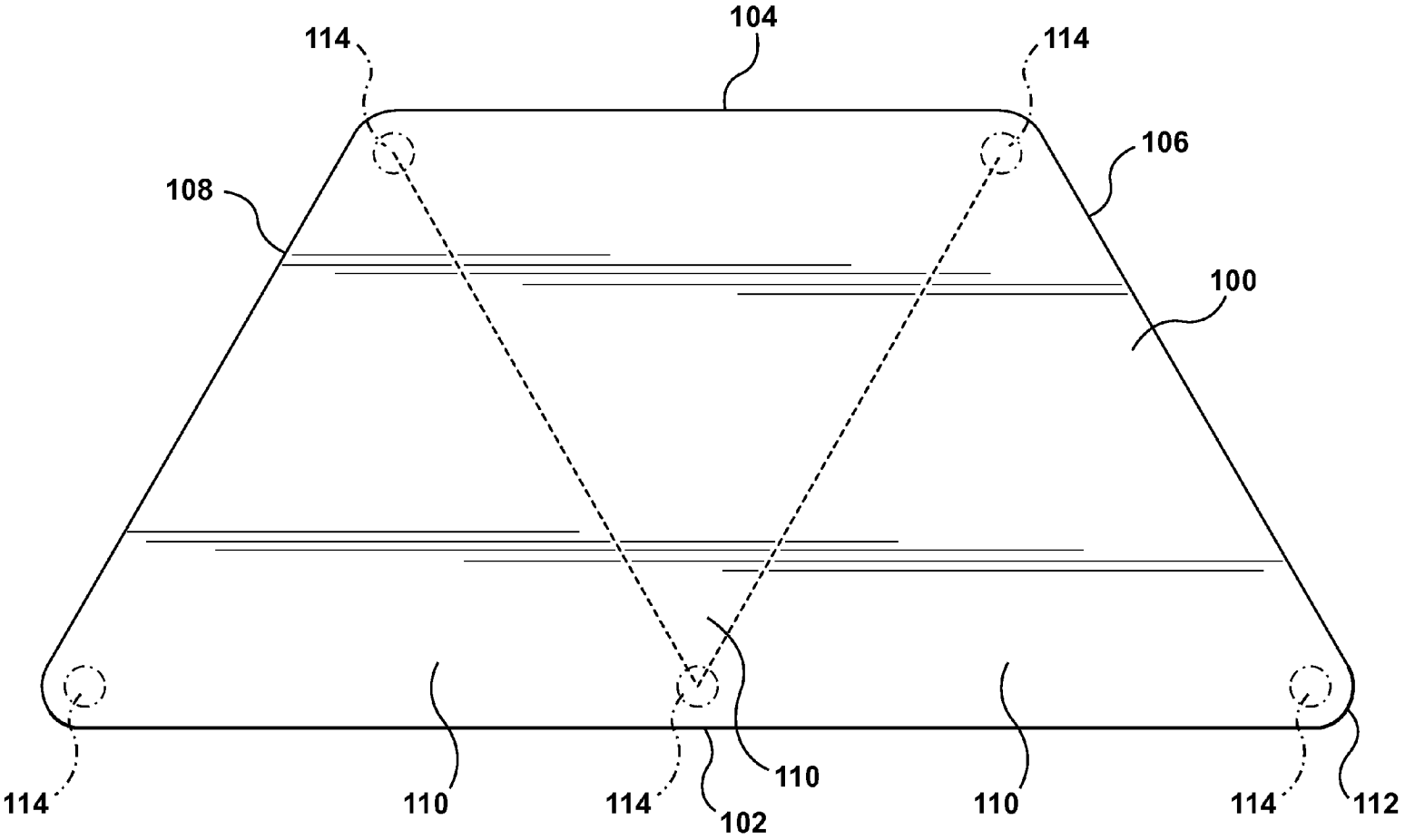
FIG. 1 illustrates an exemplary panel.

Referring now to FIG. 1, in an embodiment, each panel (100) is an isosceles trapezoid (trapezium) in which the longer base (102) is approximately twice the length of the shorter base (104) and the legs (the non-parallel sides) (106, 108) are of substantially equal length to the shorter base (104), such that the legs (106, 108) extend from the longer base (100) at an angle of approximately 60 degrees and the trapezoid essentially comprises three equivalently sized adjacent equilateral triangles (110). It will be appreciated that the trapezoid shown in FIG. 1 has rounded corners (112), for safety and aesthetic purposes, but is substantially trapezoidal in shape.

In FIG. 1, five fasteners (114) are shown wherein each one of the fasteners is equidistant to its adjacent fasteners. The fasteners (114) are shown disposed proximate the four corners of the trapezoid with a fifth fastener disposed midway between the two fasteners along the base of the trapezoid. It can be appreciated that the five fasteners essentially form vertices of the three equivalently sized equilateral triangles. Thus, the fasteners are disposed such that each fastener is adjacent to at least two equidistant other fasteners.

As previously mentioned, the fasteners may be disposed within the panel. In a particular example, these fasteners may be magnetic. Preferably, the polarity of the magnets is kept consistent among the magnets within a panel. That is, the north poles of all magnets face one surface while the south poles of all magnets face the other surface. In other embodiments, the magnets may be disposed such that the poles alternate or in another predetermined manner.

Alternatively, the fasteners may be disposed on the surface of the panel. These fasteners could be any fastener suitable to provide engagement to a complementary fastener of another panel. For example, fasteners disposed on the surface of the panel could be Velcro™ or the like (e.g., Dual Lock™), adhesive, magnetic, etc. In this case, the fasteners may comprise a set of two fasteners with one being on each surface (front, back) of the panel in substantially the same location. In other examples, the material chosen for the panel may be used as the fastener, for example where the material has characteristics of static adhesion, friction adhesion, etc. For example, the material may be a Velcro™ surface of entirely hook or entirely loop, noting that loop may be preferable for its softer characteristic. Further, the material may be felted, which may be act as a loop complementary to a hook.

Figure 2:
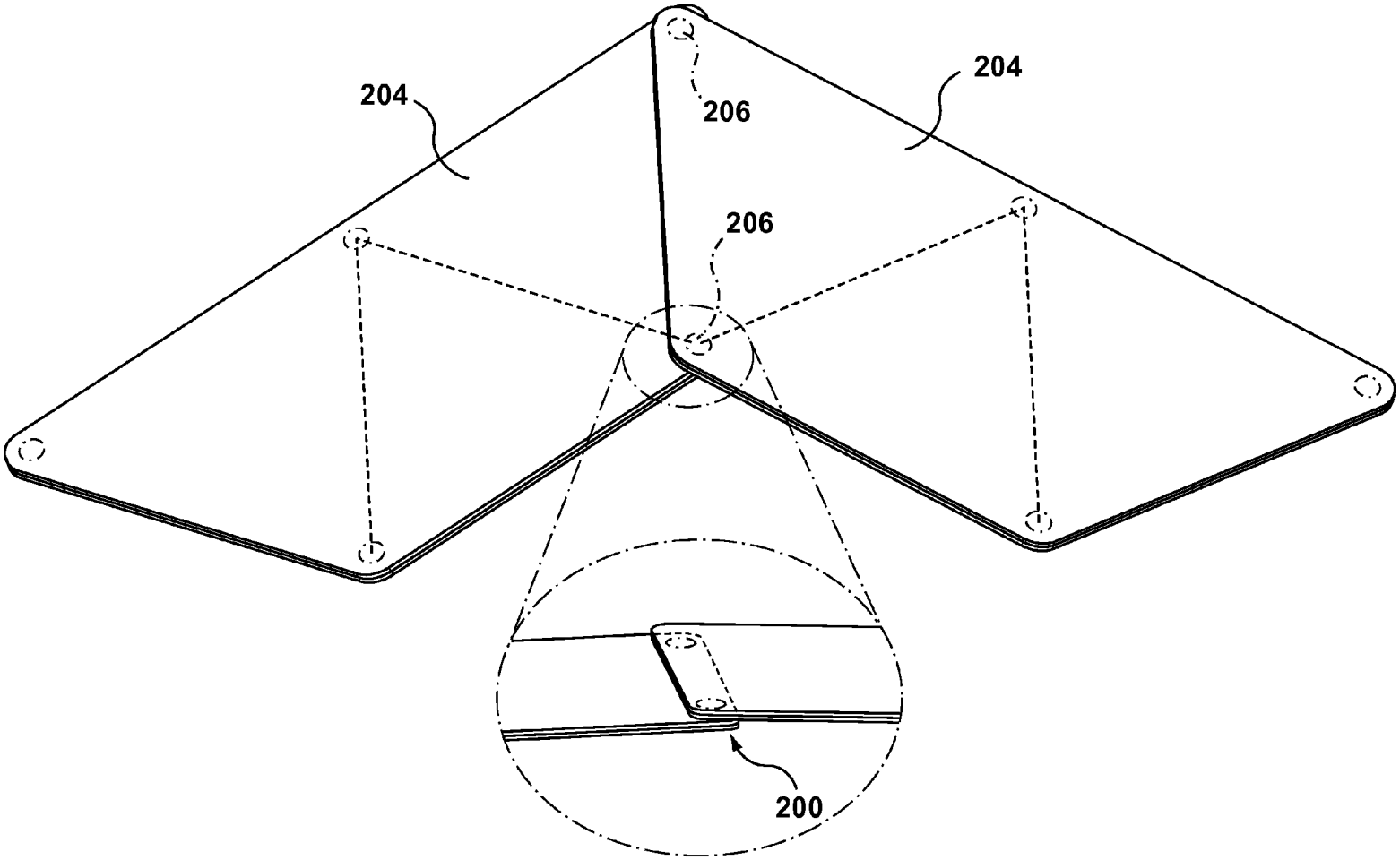
FIG. 2 illustrates a lap joint between adjacent panels.

In each case, the fasteners permit fastening to an adjoining unit. In embodiments, fastening is achieved by a lap joint (200), as shown in FIG. 2. That is, one panel (202) is fastened to an adjoining panel (204) by overlapping the fasteners (206) of the two panels. It will be appreciated that the use of the lap joint along with the equidistant positioning of the fasteners permits a high number of permutations for adjoining two panels, since, for example, two, three, four or five adjacent fasteners of one panel could be adjoined to any two adjacent fasteners of the other panel.

Figure 3:
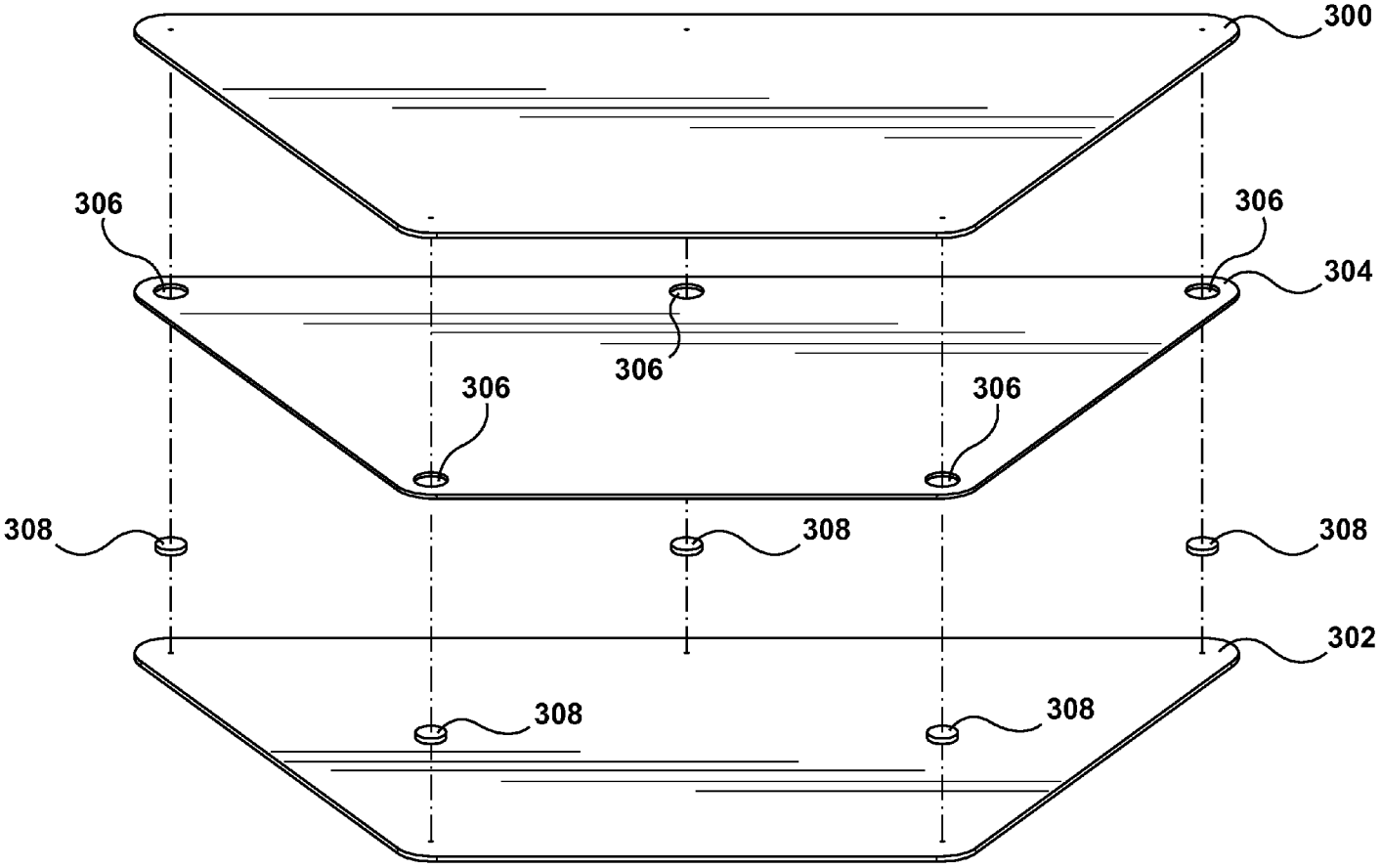
FIG. 3 illustrates a panel of FIG. 1 in exploded view.

Referring now to FIG. 3, an exemplary panel is shown in exploded view. In this example, each panel comprises a plurality of layers including two surface layers (300, 302) and an internal layer (304). In another example, the internal layer (304) is not included.

The two surface layers (300, 302) comprise similar materials. The material is preferably suitable for a toy. A preferred example is a felted or non-woven material, which is soft to the touch. Other examples include wool blends, polyester, polyurethane, polyester/polyurethane blends, vinyl, coconut, foams, or non-woven and woven materials. The internal layer (304) is a flexible material, such as a thin plastic or other flexible material that flexes but is biased to a flat state. The amount of rigidity is preferably sufficient to enable a structure built upon at least some of the panels being perpendicular or at an angle to the ground to be self-supporting; that is, to freely stand without external supporting force when a three dimensional structure (one which has a center of gravity not unreasonably high) has been created.

Figure 4:
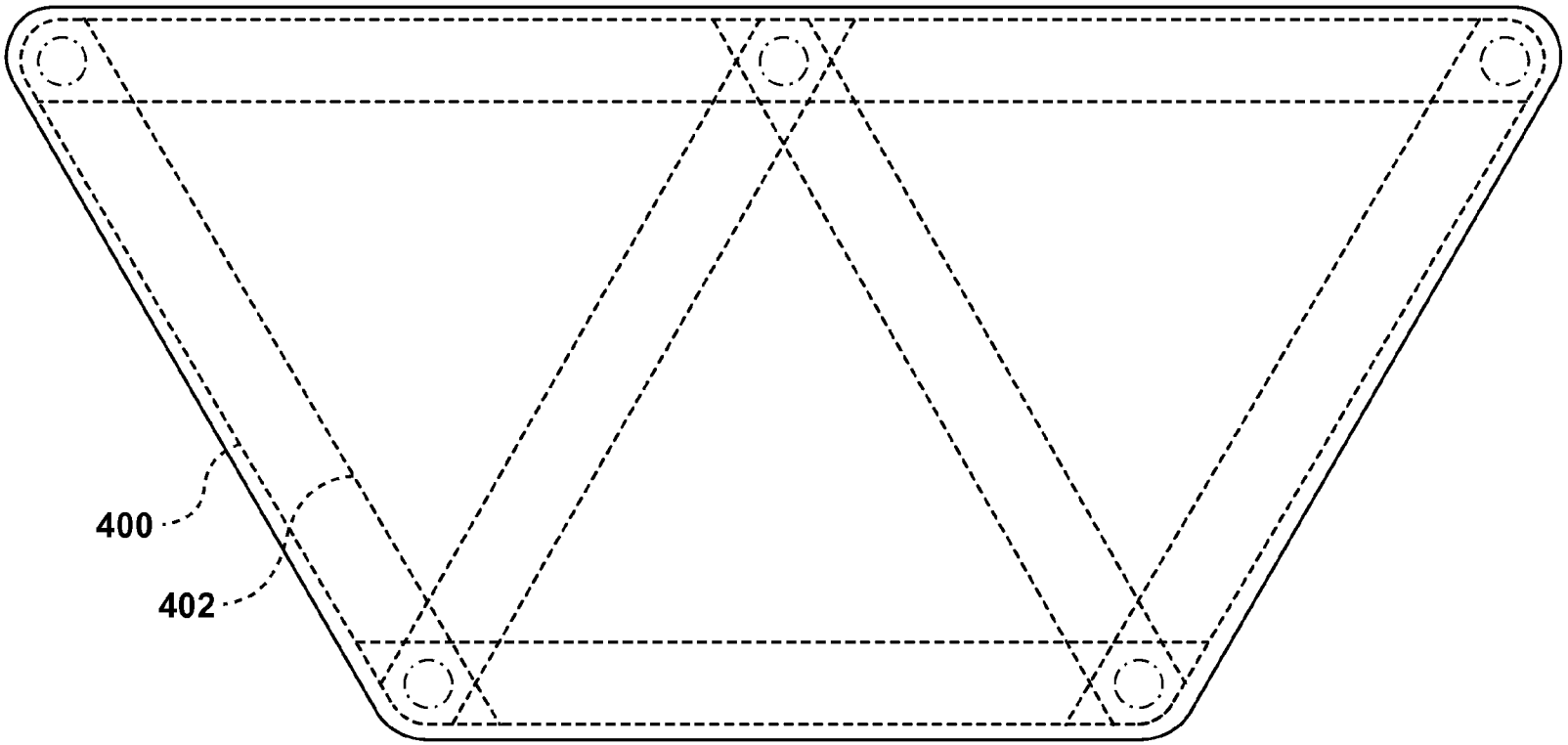
FIG. 4 illustrates placement of fasteners within or on a panel.

The internal layer (304) may have disposed therethrough a plurality of apertures (306) matching the location of the fasteners. The fasteners (308) are disposed within the apertures and held in position between the surface layers. Preferably, the layers are held together such that the fasteners cannot move substantially from their location. For example, the layers may be ultrasonically welded, fused, glued or stitched together. As shown in FIG. 4, in the case of stitching, seams may be formed in a double row (400, 402) surrounding the fasteners around the perimeter of the panel. For additional stability, stitches may further be formed in a double row from the fasteners along the shorter base to the fastener midway along the longer base. As shown in FIG. 3, further stitches can be added anywhere on the panel in an aesthetically pleasing pattern for both rigidity and appearance.

Referring now to FIGS. 5A to 5G, exemplary structures each comprising a plurality of panels are shown. Various exemplary structures are shown, though other structures could be formed, limited only by the creativity of the individual creating the structures. In the examples shown, adjoining panels are fastened by forming a lap joint by mating one or more of the fasteners of each panel. It will be appreciated that a more rigid attachment may be accomplished by mating a plurality of fasteners of adjoining panels, however more creative structures may be possible by mating just one fastener of adjoining panels.

Figure 5A:
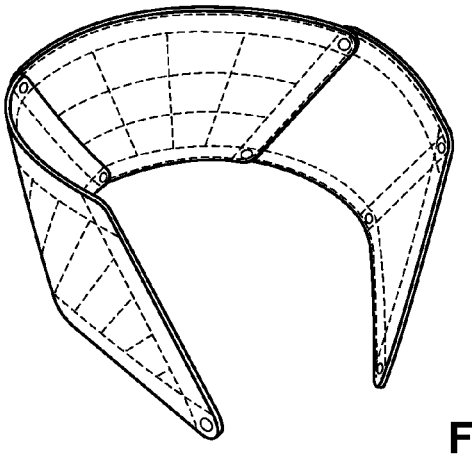
FIG. 5A illustrates a first exemplary structure of one or more of panels.
Figure 5B:
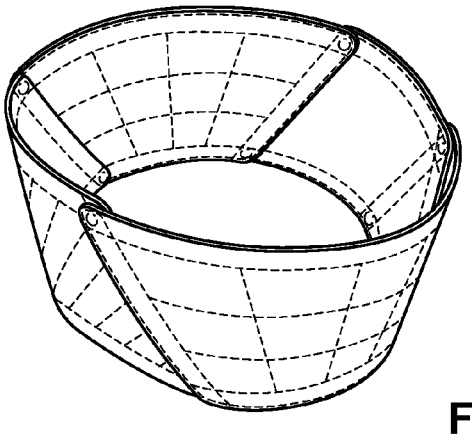
FIG. 5B illustrates a second exemplary structure of one or more of panels.
Figure 5C:
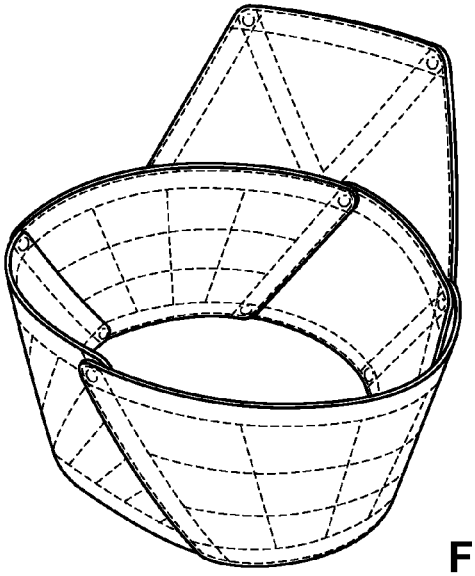
FIG. 5C illustrates a third exemplary structure of one or more of panels.

In FIG. 5A, a structure of three panels is shown. In this example, the three panels are identically shaped panels wherein a lap joint is formed between adjacent panels using two fasteners along a leg of the panels. In FIG. 5B, a structure of four panels is shown, wherein a panel is added to the structure of FIG. 5A. Similar to the structure of FIG. 5A, the panels are identically shaped panels wherein a lap joint is formed between adjacent panels using two fasteners along a leg of the panels. In FIG. 5C, a structure of five panels is shown, wherein a panel additional to the structure of FIG. 5B is adjoined to two of the panels previously used.

Figure 5D:
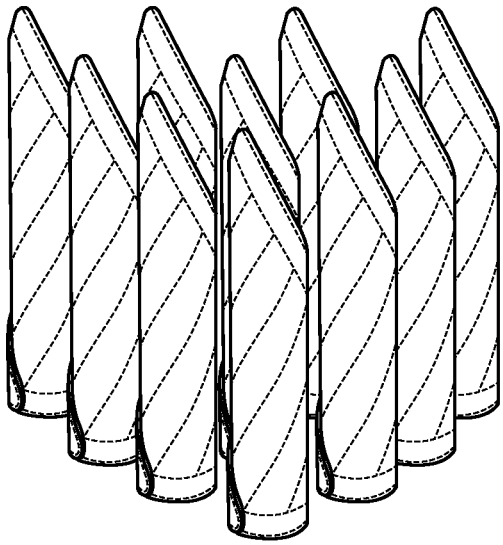
FIG. 5D illustrates a fourth exemplary structure of one or more of panels.
Figure 5E:
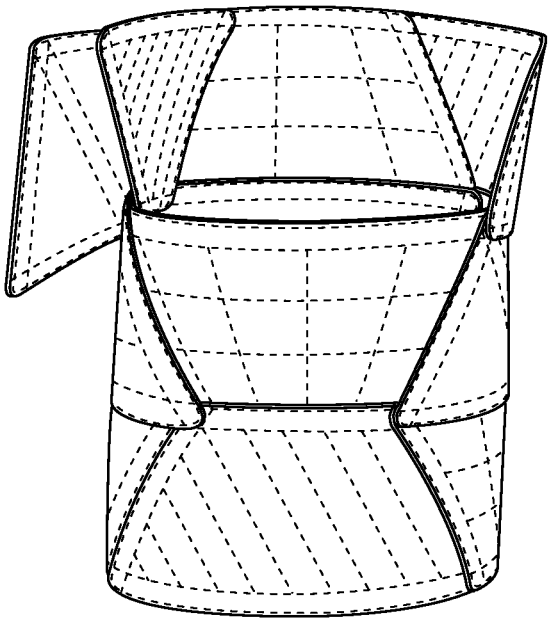
FIG. 5E illustrates a fifth exemplary structure of one or more of panels.
Figure 5F:
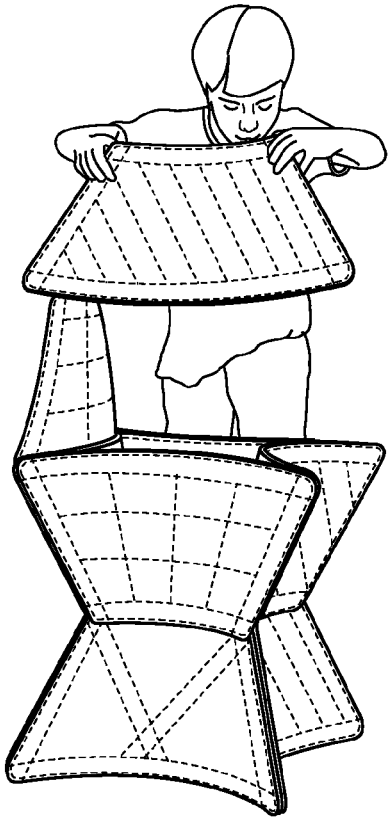
FIG. 5F illustrates a sixth exemplary structure of one or more of panels.
Figure 5G:
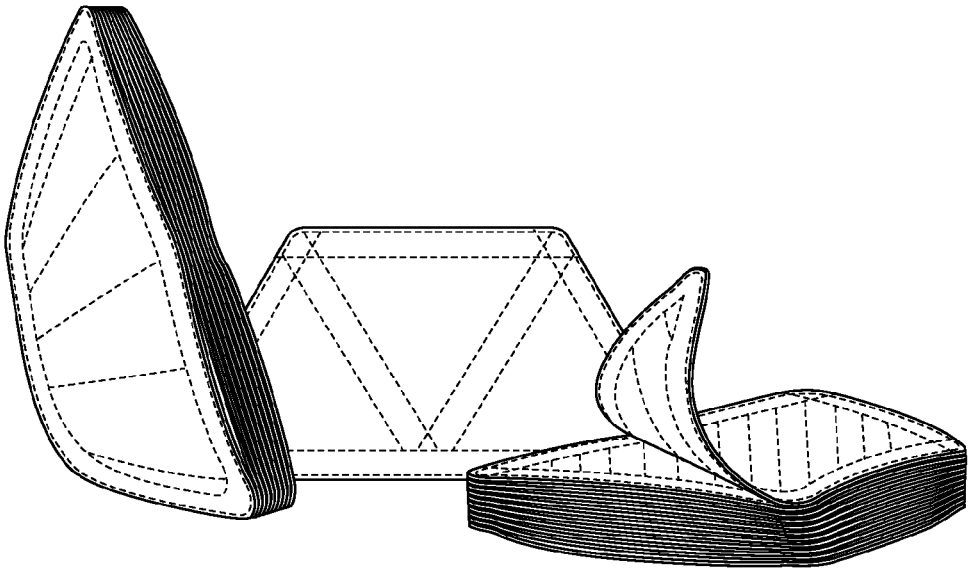
FIG. 5G illustrates a seventh exemplary structure of one or more of panels.

FIG. 5D shows an example where a panel is adhered to itself to form a tubular structure, which is shown as freestanding. FIG. 5E shows a freestanding cylindrical enclosure formed by a plurality of panels and FIG. 5F shows another freestanding enclosure. FIG. 5G shows an example where a plurality of panels are stacked one upon another.

Figure 6A:
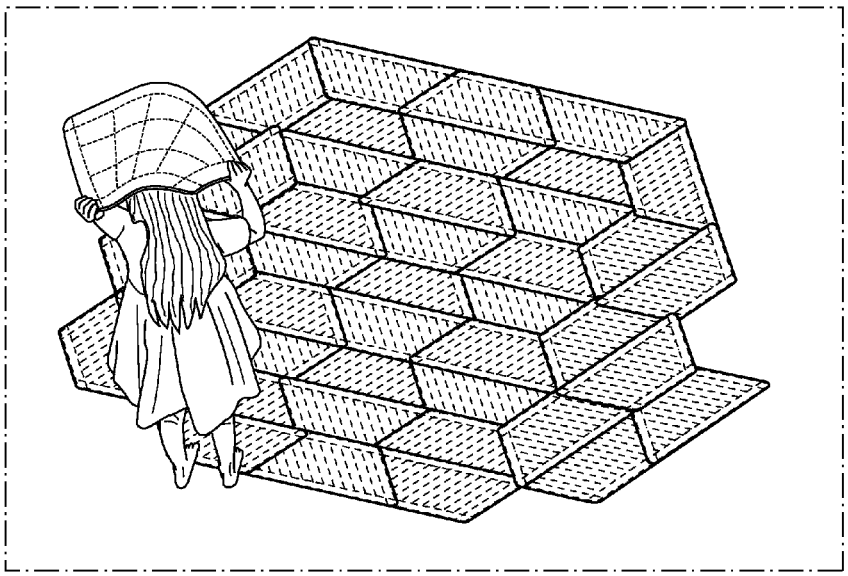
FIG. 6A illustrates a first additional two-dimensional structure of a plurality of panels.
Figure 6B:
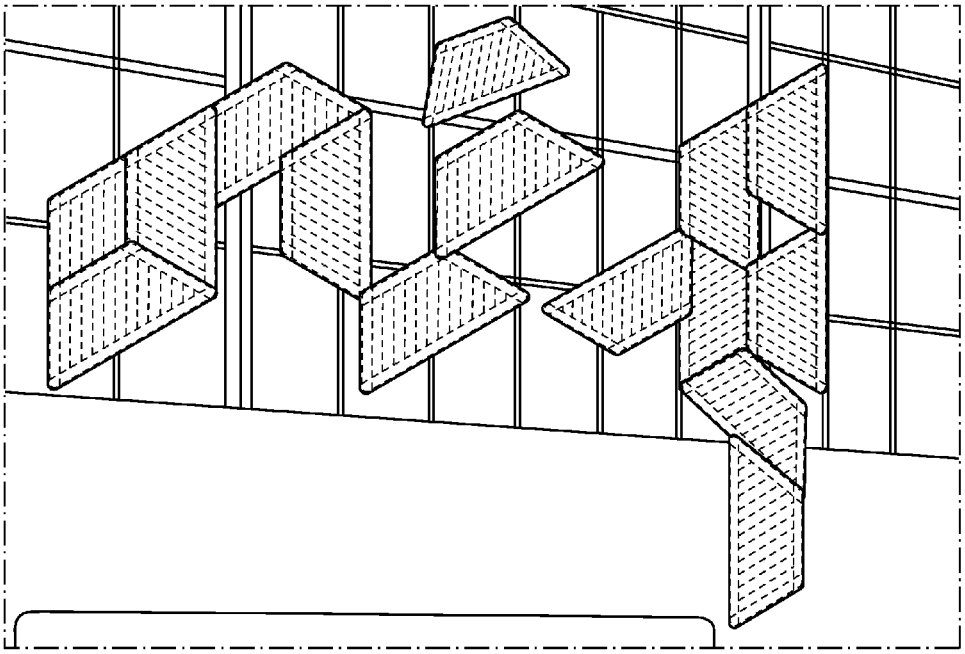
FIG. 6B illustrates a second additional two-dimensional structure of a plurality of panels.

FIGS. 6A and 6B shows various two-dimensional structures. FIG. 6A shows an example where the panels are joined to form a two dimensional flooring structure. FIG. 6B shows another two dimensional example of a window covering, which is further held against a window by magnetic bond to a metallic window frame.

Figure 7A:
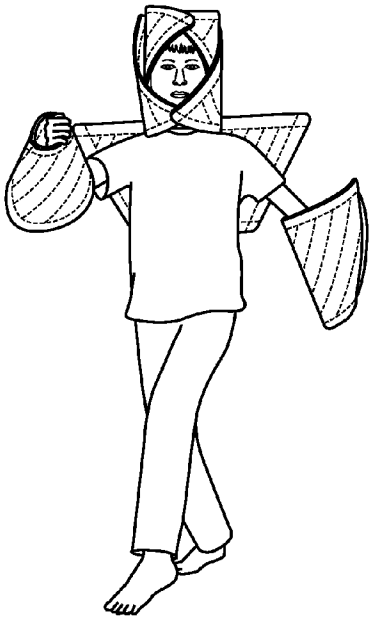
FIG. 7A illustrates a first exemplary clothing or costume structure of one or more panels.
Figure 7B:
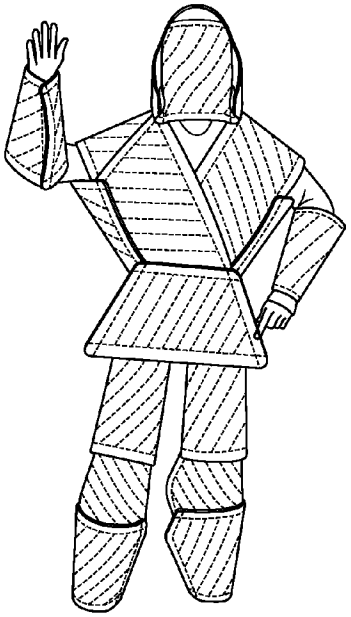
FIG. 7B illustrates a second exemplary clothing or costume structure of one or more panels.
Figure 7C:
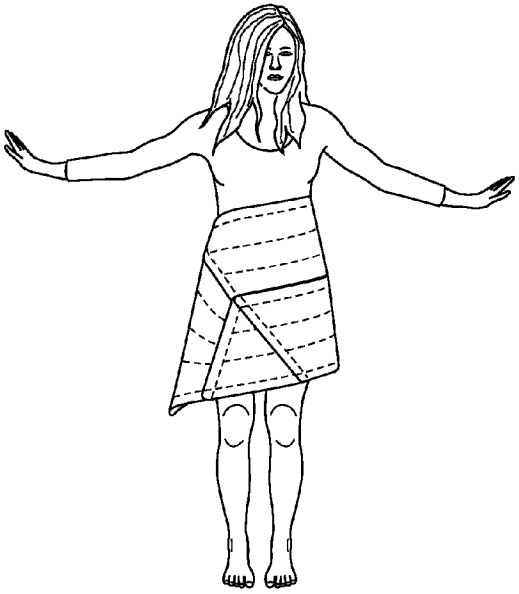
FIG. 7C illustrates a third exemplary clothing or costume structure of one or more panels.

FIGS. 7A to 7C shows various costume or clothing structures that could be created, including a helmet and sleeves in FIG. 7A, full body armour costume in FIG. 7B and a skirt in FIG. 7C.

Preferably, as the panels are flexible, some or all of the panels can be held in a flexed position to increase the number of structures that can be created.

Figure 8A:
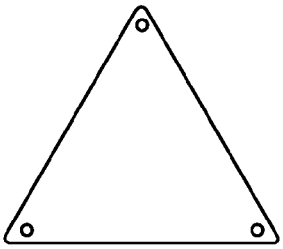
FIG. 8A illustrates a first shape of panel.
Figure 8B:
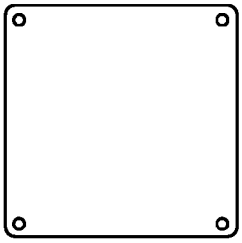
FIG. 8B illustrates a second shape of panel.
Figure 8C:
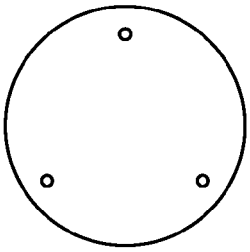
FIG. 8C illustrates a third shape of panel.
Figure 8D:
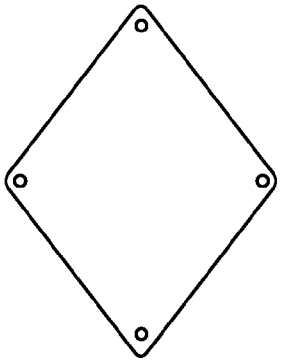
FIG. 8D illustrates a fourth shape of panel.
Figure 8E:
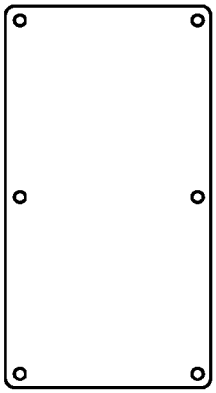
FIG. 8E illustrates a fifth shape of panel.
Figure 8F:
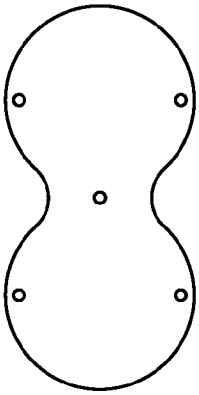
FIG. 8F illustrates a sixth shape of panel.
Figure 8G:
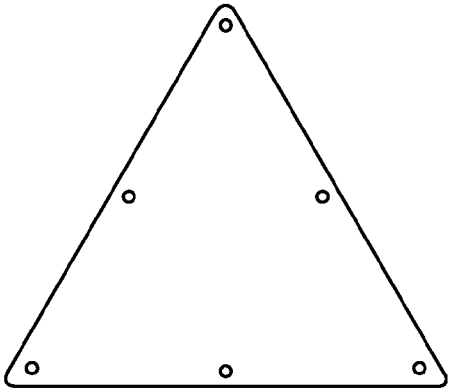
FIG. 8G illustrates a seventh shape of panel.
Figure 8H:
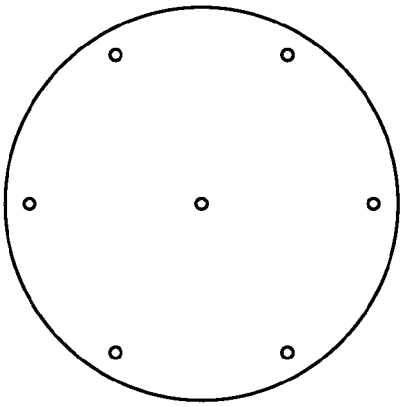
FIG. 8H illustrates an eighth shape of panel.

Referring now to FIGS. 8A to 8H, other panel shapes are shown, although further shapes may be provided. The panels shown in FIGS. 8A to 8H are generally symmetrical about an axis, though irregular shapes could also be used. For generally symmetrical panels, it is more easily understood to position the fasteners in such a manner that they are equidistant. FIG. 8A shows a triangular panel. The panel may have three fasteners proximate the vertices of the triangle, though other approaches are possible, such as by placing an additional fastener intermediate each fastener shown, as seen in FIG. 8G, and additionally another fastener may be disposed at the centre of the triangle. FIG. 8B shows a square panel which, in this example, has four fasteners at its corners though, again, other approaches are possible. FIG. 8C shows a circular panel having three equidistant fasteners, though additional fasteners may be disposed around the perimeter of the circle and at its centre, as shown in FIG. 8H. FIG. 8D shows a diamond shaped panel having four fasteners at its corners. FIG. 8E shows a rectangular panel having six fasteners. FIG. 8F shows an irregularly shaped dual part-circular panel having five fasteners.

The herein described panels are further useful for modular building components for constructing toys, structures, costumes, clothing, living room objects, carpets, wall art, sculptures, furniture, and window blinds; modular building components for dividing space; modular building components used for sound absorption; and modular building components for constructing home décor accessories.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

I claim:

1. A unit for a modular construction set, the unit comprising:

a panel having a front surface and a back surface, the panel having an internal layer made of flexible material able to be flexed in any direction and that allows the panel to flex and biases the panel to a flat state, the panel further having two soft surface layers defining the front surface and the back surface, the internal layer being located between the two soft surface layers, the internal layer having a plurality of apertures that are covered by the two soft surface layers; and a plurality of fasteners, each fastener located within an aperture of the plurality of apertures;

all fasteners of the plurality of fasteners being oriented in the same direction in relation to the front surface and the back surface;

the plurality of fasteners being evenly spaced at discrete locations around at least a perimeter of the panel, each adjacent pair of fasteners of the plurality of fasteners being positioned to engage with each adjacent pair of oppositely facing fasteners of another unit of the modular construction set to form a lap joint, in which the front surface of the panel is releasably held to a back surface of a panel of the other unit of the modular construction set.

2. The unit of claim 1, wherein one or more fasteners of the plurality of fasteners is disposed at a corner of the panel.

3. The unit of claim 1, wherein the panel is a substantially trapezoidal panel.

4. The unit of claim 3, wherein the substantially trapezoidal panel has a longer base substantially twice the length of a shorter base and two legs extending from the longer base at approximately sixty degrees.

5. The unit of claim 4, wherein the plurality of fasteners comprises five fasteners disposed substantially at four corners of the substantially trapezoidal panel and midway between two corners of the longer base of the substantially trapezoidal panel.

6. The unit of claim 5, further comprising stitching in the substantially trapezoidal panel to maintain each fastener in position.

7. The unit of claim 5, wherein each fastener is maintained in position by ultrasonic welding each fastener to the substantially trapezoidal panel.

8. The unit of claim 5, wherein each fastener is maintained in position by gluing each fastener to or within the substantially trapezoidal panel.

9. The unit of claim 1, wherein each fastener is a magnet disposed within the panel, all magnets having poles oriented in the same direction in relation to the front surface and the back surface.

10. The unit of claim 1, wherein the two surface layers comprise a non-woven material.

11. The unit of claim 10, wherein the non-woven material is felted.

12. The unit of claim 1, wherein the internal layer comprises a flexible material.

13. The unit of claim 1, wherein each fastener and its two nearest neighboring fasteners are positioned to define vertices of an equilateral triangle.

14. The unit of claim 1, wherein the panel comprises a woven material.

15. The unit of claim 1, wherein the panel comprises foam.

16. A modular construction set comprising:

a plurality of units, each unit including:

a panel having a front surface and a back surface, the panel having an internal layer made of flexible material able to be flexed in any direction and that allows the panel to flex and biases the panel to a flat state, the panel further having two soft surface layers defining the front surface and the back surface, the internal layer being located between the two soft surface layers, the internal layer having a plurality of apertures that are covered by the two soft surface layers; and a plurality of fasteners, each fastener located within an aperture of the plurality of apertures, all fasteners of the plurality of fasteners being oriented in the same direction in relation to the front surface and the back surface;

the plurality of fasteners of each unit of the plurality of units being evenly spaced at discrete locations around at least a perimeter of the panel, each adjacent pair of fasteners of each unit being positioned to be able to form a releasable lap joint with each adjacent pair of fasteners of another unit of the plurality of units;

the flexible material having rigidity sufficient to form a self-supporting structure from the plurality of units joined by a plurality of releasable lap joints.

17. The modular construction set of claim 16, wherein the structure is a wearable structure.

18. The modular construction set of claim 17, wherein the structure is a costume structure.

19. The modular construction set of claim 16, wherein the structure is sculptural structure.

20. The modular construction set of claim 16, wherein each unit is identically shaped.

21. The modular construction set of claim 16, wherein the plurality of units are stacked one upon another to completely overlap.

22. A unit for a modular construction set, the unit comprising:

a panel having a front surface and a back surface, the panel having a plurality of layers that are held together, at least one layer of the plurality of layers comprising a flexible material that allows the panel to flex and biases the panel to a flat state, at least another layer of the plurality of layers comprising a soft material;

a plurality of magnets, each magnet of the plurality of magnets embedded within a respective aperture formed within an internal layer of the plurality of layers, the plurality of layers being held together to secure each magnet in the respective aperture;

all magnets of the plurality of magnets secured to have poles oriented in the same direction in relation to the front surface and the back surface;

the plurality of magnets being evenly spaced at discrete locations around at least a perimeter of the panel, each adjacent pair of magnets of the plurality of magnets being positioned to engage with each adjacent pair of oppositely facing magnets of another unit of the modular construction set to form a lap joint, in which the front surface of the panel is releasably held to a back surface of a panel of the other unit of the modular construction set.

* * * * *